US008111801B2

(12) United States Patent
Hur et al.

(10) Patent No.: US 8,111,801 B2
(45) Date of Patent: Feb. 7, 2012

(54) RADIOISOTOPE PRODUCTION GAS TARGET HAVING FIN STRUCTURE

(75) Inventors: Min Goo Hur, Gyeonggi-do (KR); Sang Wook Kim, Gyeonggi-do (KR); Seung Dae Yang, Jeollabuk-do (KR)

(73) Assignee: Korea Atomic Energy Research Institute, Daejeon (KR)

( * ) Notice: Subject to any disclaimer, the term of this patent is extended or adjusted under 35 U.S.C. 154(b) by 239 days.

(21) Appl. No.: 12/255,441

(22) Filed: Oct. 21, 2008

(65) Prior Publication Data

US 2009/0274259 A1 Nov. 5, 2009

(30) Foreign Application Priority Data

Apr. 30, 2008 (KR) ..... 10-2008-0040632

(51) Int. Cl.
*G21G 1/10* (2006.01)

(52) U.S. Cl. ..... 376/202; 376/194

(58) Field of Classification Search ..... 376/202
See application file for complete search history.

(56) References Cited

U.S. PATENT DOCUMENTS 4,306,619 A * 12/1981 Trojani ..... 165/179
6,845,137 B2 1/2005 Ruth et al.
6,917,044 B2 7/2005 Amini
7,200,198 B2 * 4/2007 Wieland et al. ..... 376/195
2005/0201504 A1 * 9/2005 Zeisler et al. ..... 376/156
2007/0040115 A1 * 2/2007 Publicover et al. ..... 250/305

OTHER PUBLICATIONS

Heselis et al, "Studies of Emission-line Profiles from Ion-excited Neon Gar Targets," The International Journal of Applied Radiation and Isotopes, vol. 35, Issue 10, Oct. 1984, pp. 977-980.

Heselius, et al., "Optical Studies of the Influence of an Intense Ion Beam on High-Pressure Gas Targets," The International Journal of Applied Radiation and Isotopes, vol. 33, Issue 8, Aug. 1982, pp. 653-659.

* cited by examiner

*Primary Examiner* — Johannes P Mondt
(74) *Attorney, Agent, or Firm* — Fredrikson & Byron, PA

(57) ABSTRACT

A radioisotope production gas target for producing gas isotopes such as C-11. The radioisotope production gas target includes a target chamber that is in the shape of a hollow cylinder and has a plurality of inner fins protruding from an inner surface thereof along a length thereof, and a body that is shaped of a hollow cylinder enclosing the target chamber, and has a target gas inlet for feeding target gas to a hollow region of the target chamber, a target gas outlet for collecting the target gas after a nuclear reaction occurs, and a first coolant inlet and a first coolant outlet respectively feeding and discharging a coolant flowing along an outer surface of the target chamber, and includes a thin metal sheet in front thereof through which a beam of protons passes.

7 Claims, 7 Drawing Sheets

RADIOISOTOPE PRODUCTION GAS TARGET HAVING FIN STRUCTURE

RELATED APPLICATIONS

This application claims priority to Korean Application No. KR10-2008-0040632 filed Apr. 30, 2008, the teachings of which are incorporated herein by reference.

BACKGROUND OF THE INVENTION

1. Field of the Invention

The present invention relates, in general, to a gas target for producing gas isotopes such as C-11 and, more particularly, to a radioisotope production gas target, in which a fin structure is formed in an internal space, i.e. a target cavity, in which stable isotopes that are target materials cause a nuclear reaction with protons, thereby stably and remarkably increasing a yield of the production of the isotopes.

2. Description of the Related Art

Generally, isotopes are produced by irradiating protons or neutrons to stable isotopes. In this manner, a mechanism or an apparatus that makes it possible to irradiate the protons or the neutrons to the stable isotopes refers to a target.

A radioactive medicament called 2-[$^{18}$F]fluoro-2-deoxy-D-glucose ([$^{18}$F]FDG) (hereinafter, referred to as "FDG") that synthesizes fluorine (F) into glucose is used in positron emission tomography (PET) for the diagnosis of tumors or cancer. In the case of image diagnosis of a brain or a heart, gas isotopes such as C-11 are used for high reliability. The representative gas isotope, C-11, is converted into a radioactive compound such as methyl iodide (MeI) or acetate, and then is used for diagnosis.

The gas isotopes such as C-11 are produced by irradiating accelerated protons to gaseous stable isotopes. An apparatus for accelerating the protons is an accelerator called a cyclotron, which is widely used for research and diagnosis in many institutes which use the PET.

The gas target is basically configured of a target window that is an entrance into which the protons accelerated by the cyclotron are sent, a target cavity that is a space in which the accelerated protons cause a nuclear reaction with the target materials (or stable isotopes) so as to produce radioisotopes, a target cooling system that collects heat generated by energy absorption at the target cavity, and a targetry system that supplies the stable isotopes to the target and collects the produced radioisotopes.

The gas isotopes, C-11, which are to be used in the PET are produced through a nuclear reaction, $^{14}N(p,\alpha)^{11}C$, by generating a beam of protons from the accelerator, that is, the cyclotron, and irradiating the protons generated from the cyclotron to the stable isotopes, $N_2$, that are the target materials.

The protons accelerated by the cyclotron are characterized in that the energy thereof is sharply reduced according to the density of material. Thus, the target window, which is a target incident section for producing the isotopes, is designed to least have only a mechanism so as to be able to maintain the proton energy at the maximum extent. For this reason, a thin metal sheet is used in the front of the target window through which the proton beam passes, and a structure such as a grid structure is installed together so as to be able to withstand high pressure.

FIG. 1 illustrates one example of a conventional gas target that is designed and used according to the aforementioned principle and basic configuration. A target window 10 onto which the proton beam is incident has a diameter of about 20 mm, which is designed to an appropriate size so that the proton beam can pass through when the proton beam generated from the cyclotron is widened to the maximum extent. A support structure 12 is installed adjacent to the target window 10 so as to support a thin metal sheet 14.

The gas target used for producing the isotopes is divided into two types, a cylindrical type and a conical type, according to a shape thereof. The conical type gas target is adapted to the spatial shape of proton beam locus increasing its cross section by scattering as it approaches the second half thereof in the gas target (see FIG. 2).

A portion where the nuclear reaction is produced by the proton beam undergoes a phenomenon called density reduction caused by compressibility of gas as well as generation of heat. Here, the density reduction refers to an effect where the heat is generated from portion where the nuclear reaction occurs by the application of the proton beam, and thus the portion where the nuclear reaction occurs is subjected to a reduction in density, whereas a surrounding portion remote from the portion where the nuclear reaction occurs is subjected to an increase in density. For this reason, a length of the proton beam passing through the gas is varied, and secondary beam scattering takes place at a rear end where the nuclear reaction occurs (*The International Journal of Applied Radiation and Isotopes*, Volume 33, Issue 8, August 1982, Pages 653-659, Sven-Johan Heselius, Peter Lindblom, Olof Solin; *The International Journal of Applied Radiation and Isotopes*, Volume 35, Issue 10, October 1984, Pages 977-980, Sven-Johan Heselius, Peter Lindblom, Ebbe M. Nyman, Olof Solin).

Further, when beam divergence is larger than the diameter of an interior of the target, i.e. a target cavity, according to a characteristic of the proton beam, this leads to a loss of the energy of the proton beam, and thus serves as a factor that reduces production yield of radioisotopes. Accordingly, the loss of the proton beam energy is prevented by a conical gas target, which has been recently manufactured according to a shape corresponding to a shape of the beam divergence. Thereby, the conical gas target is being studied beginning from the concept that the conical gas target obtains a yield higher than that of the cylindrical gas target.

However, the production of the radioisotopes using the cylindrical or conical gas target is basically accompanied with a generation of high pressure, so that it causes a problem with safety of the thin metal sheet installed as the target window. Further, such production fails to effectively inhibit the effect of the density reduction caused by the nuclear reaction, so that it increases instability of the production yield. In other words, only the conversion of the shape of the gas target from the cylindrical type to the conical type has a limitation to improving the production yield of the radioisotopes and maintaining production stability of the radioisotopes.

In order to ensure a stable production yield of the radioisotopes, it is necessary to effectively cool the gas target. Thus, the conventional gas targets as illustrated in FIG. 1 have employed a method of lowering a temperature of a coolant flowing through a cooling channel 18 installed outside a target chamber 16 in order to inhibit the gas in the target chamber 16 from being raised in temperature, or a method of increasing a heat transfer area by forming cooling fins (not shown) on an outer surface of the target chamber 16 that is in contact with the coolant.

However, the cooling fins are based on a basic concept that the cooling fins are installed when heat exchange and heat transfer effects of a fluid can be expected to be improved by increasing a heat radiation surface area in a direction in which the heat transfer from the fluid does not sufficiently occur. As such, the configuration in which the cooling fins are formed on the outer surface of the target cavity as in the conventional gas target is estimated to be not quite optimal.

In other words, when the cooling fins are formed on the outer surface of the target cavity, the outer surface of the target cavity that is in contact with the coolant may be sufficiently cooled. However, since the capacity of heat transmitted from the target gas of the target cavity which is generally no more than one several hundredth of the liquid to the outer surface of the target cavity is not sufficient, it will be difficult to expect the cooling of the target gas. As such, it is necessary to design the gas target based on a new concept so that the target material, i.e. the gas, in the target cavity itself can be effectively cooled.

SUMMARY OF THE INVENTION

Accordingly, it is an aspect of the present invention to provide a new concept of radioisotope production gas target, which can be applied to a conventional cylindrical gas target as well as a conical gas target considering a divergence phenomenon of a beam of protons, and thus improve yield and stability in the production of isotopes.

According to exemplary embodiments of the present invention, the radioisotope production gas target can directly and more efficiently cool gases in a gas chamber in order to accomplish the yield and stability of the production of isotopes.

Additional aspects and/or advantages of the invention will be set forth in part in the description which follows and, in part, will be apparent from the description, or may be learned by practice of the invention.

The foregoing and/or other aspects of the present invention are achieved by providing a radioisotope production gas target, which includes: a target chamber that is shaped of a hollow cylinder and has a plurality of inner fins protruding from an inner surface thereof along a length thereof; and a body that is shaped of a hollow cylinder enclosing the target chamber, has a target gas inlet for feeding target gas to a hollow region of the target chamber (the hollow region being the interior volume of the target chamber), a target gas outlet for collecting the target gas after a nuclear reaction occurs, and a first coolant inlet and a first coolant outlet for feeding and discharging a coolant flowing along an outer surface of the target chamber, and includes a thin metal sheet in the front thereof through which a beam of protons passes.

According to an embodiment of the present invention, the body may include: a front adaptor that is shaped of a ring, a central part of which is bored, and which has a circular groove on a radial outer side of the central part, that has the target gas inlet communicating with the bored central part in a front surface of the front adaptor and the first coolant inlet communicating with the groove in a rear surface of the front adaptor, and that is coupled to a front end of the target chamber such that the bored central part communicates with a hollow region of the target chamber with the groove facing the target chamber; a rear adaptor that is coupled to a rear end of the target chamber, includes the target gas outlet in an outer circumference thereof which communicates with the hollow region of the target chamber, and at least one slot in an inner circumference thereof at a portion where the rear adaptor is coupled with the target chamber; casings coupled between the front adaptor and the rear adaptor so as to enclose an outside of the groove of the front adaptor and an outside of the slot of the rear adaptor; a front flange having a grid structure supporting a thin metal sheet and coupled to a front surface of the front adaptor; and a rear flange having the first coolant outlet and coupled to a rear surface of the rear adaptor. Further, the thin metal sheet may be disposed between the front adaptor and the front flange.

According to another embodiment of the present invention, the target chamber may be formed by coupling a plurality of target chamber units having at least one of the inner fins. Particularly, the target chamber units may be coupled with each other by welding.

According to another embodiment of the present invention, the target chamber may include a plurality of outer fins protruding from the outer surface thereof along the length thereof. In this case, the target chamber may be formed by coupling a plurality of target chamber units having at least one of the inner fins and at least one of the outer fins. Particularly, the target chamber units may be coupled with each other by welding so as to be able to maintain internal airtightness.

According to another embodiment of the present invention, the front flange may include a groove formed around the grid structure, and a cover member covering a front of the groove, and have second coolant inlet and outlet in an outer circumference thereof. Here, the second coolant inlet and outlet may be formed so as to be opposite to each other.

According to another embodiment of the present invention, the rear adaptor may include a concave space recessed from a portion where the rear adaptor is coupled to the rear end of the target chamber.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
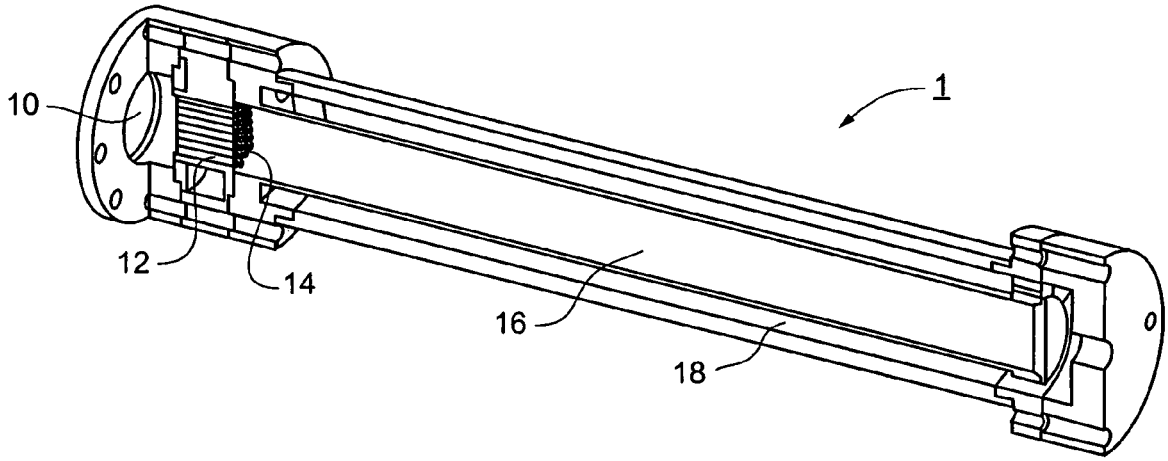
Fig. 1 Prior Art
FIG. 1 is a perspective view illustrating one example of a conventional gas target.

Reference will now be made in greater detail to a radioisotope production gas target according to an exemplary embodiment of the invention with reference to the accompanying drawings. Wherever possible, the same reference numerals will be used throughout the drawings and the description to refer to the same or like parts.

The radioisotope production gas target 100 according to an exemplary embodiment of the invention generally includes: a target chamber 110 that is shaped of a hollow cylinder and has a plurality of inner fins 112 protruding from an inner surface thereof along a length thereof in a radial inward direction; and a body that is shaped of a hollow cylinder enclosing the target chamber 110, which has a target gas inlet 124 for feeding target gas to a hollow region in the target chamber 110, a target gas outlet 134 for collecting the target gas after a nuclear reaction occurs, and a first coolant inlet 122 and a first coolant outlet 172 for respectively feeding and discharging a coolant flowing along an outer surface of the target chamber 110, and is provided with a thin metal sheet 162 in a front thereof through which a beam of protons passes.

Thus, the gas target 100 having this structure is configured in such a manner that, because the hollow body encloses the outside of the hollow target chamber 110, an annular space is defined between an inner surface of the body and the outer surface of the target chamber 110, and a circular cross-sectional space is defined by an inner surface of the target chamber 110. The annular space, which is defined between the inner surface of the body and the outer surface of the target chamber 110, functions as a coolant channel through which a coolant, for instance, a fluid such as water, flows. The circular cross-sectional space, which is defined by an inner surface of the target chamber 110, functions as a channel which is filled with target gas, for instance with a target material such as stable isotopes, $N_2$, for producing gas isotopes, C-11.

Particularly, it should be noted that the target chamber 110 of the gas target 100 is provided with the plurality of inner fins 112, which protrudes from the inner surface of the target chamber 110 along the length of the target chamber 110 in a radial inward direction. In this manner, since the inner fins 112 are formed on the inner surface of the target chamber 110 along the length of the target chamber 110 in a radial inward direction, the gas target 100 according to the embodiment of the present invention can more effectively and directly transmit heat, which is generated by the nuclear reaction of the target gas in the process of the nuclear reaction and is a property of the gas in the target chamber 110 including gas isotopes, to the outside.

Figure 2:
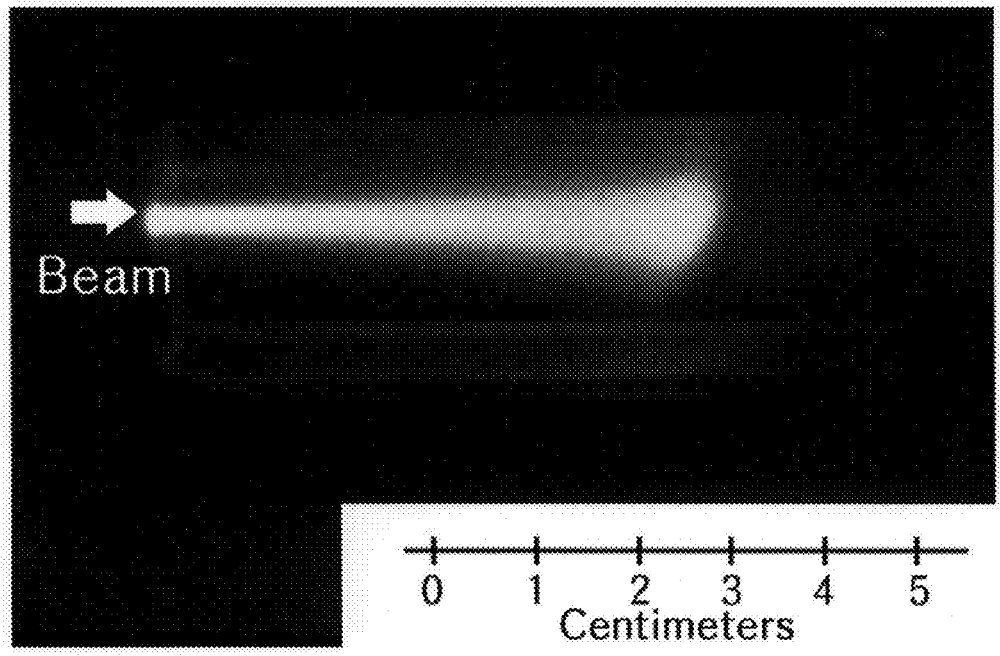
FIG. 2 is a photograph taken of divergence of a beam of protons in a target chamber (Optical Studies of the Influence of an Intense Ion Beam on High-pressure Gas Targets—The International Journal of Applied Radiation and Isotopes, Volume 33, Issue 8, August 1982, Pages 653-659, Sven-Johan Heselius, Peter Lindblom, Olof Solin)

Preferably, the inner fins 112 are formed on the inner surface of the target chamber 110 in a radial inward direction. This is because the gas heated in the target chamber 110 undergoes convention around the proton beam having the conical locus as illustrated in FIG. 2 in a lengthwise direction of the proton beam. Thus, the configuration in which the inner fins 112 are formed on the inner surface of the target chamber 110 in a radial inward direction is more efficient from the viewpoint of heat transfer.

The target chamber 110 may be configured in such a manner that a plurality of target chamber units 110' having at least one of the inner fins 112 is coupled with each other. In this manner, the configuration in which the individual target chamber units 110' are coupled with each other without manufacturing the target chamber 110 in an integrated shape is advantageous in that it can not only improve convenience of manufacturing but also makes it easier to adjust the length of the target chamber by means of adjustment of the number of target chamber units 110' so as to be able to manufacture the target chamber 110 in various sizes. Preferably, these target chamber units 110' are mutually coupled by welding in order to maintain good airtightness. Of course, any other replaceable coupling method can be used as long as the airtightness of the target chamber 110 can be maintained.

Further, the target chamber 110 may be additionally provided with a plurality of outer fins 112' protruding from the outer surface thereof along the length thereof in a radial outward direction in addition to the inner fins 112. This is equally applied to each target chamber unit 110'. Thus, each target chamber unit 110' may be additionally provided with at least one outer fin 112' protruding from the outer surface thereof along the length thereof in a radial outward direction. The outer fins 112' are for improving heat transfer efficiency. Owing to this heat transfer efficiency, the heat transmitted from the gases in the target chamber to the outer surface of the target chamber 110 through the inner fins 112 is transmitted to the coolant flowing along the outer surface of the target chamber 110. Making reference to the target chamber units 110' in greater detail, the inner and outer fins 112 and 112' are formed on the inner and outer surfaces of each target chamber unit 110', respectively.

The body enclosing the target chamber 110 having the aforementioned configuration has the shape of a hollow cylinder, and includes the target gas inlet 124 feeding the target gas to the hollow region in the target chamber 110, the target gas outlet 134 collecting the target gas after the nuclear reaction occurs, and the first coolant inlet 122 and the first coolant outlet 172 feeding and discharging the coolant flowing to and from the annular coolant channel, which is defined between the inner surface of the body and the outer surface of the target chamber 110. Preferably, the target gas inlet 124 and the first coolant inlet 122 are formed at a first end of the body, while the target gas outlet 134 and the first coolant output 172 are formed at the second end of the body.

Further, the body is provided with a grid structure 168 through which the proton beam passes at one end thereof at which the target gas inlet 124 and the first coolant inlet 122 are formed together which the thin metal sheet 162. The configuration of the body will be described below in detail. In this case, in consideration of the ease of description together with a function of the body, the first end of the body having the grid structure 168, the entrance through which the proton beam passes, and the thin metal sheet 162 will be called a front portion, and the second end of the body, that is, the exit through which the coolant and the gas isotopes are discharged, will be called a rear portion.

Figure 3:
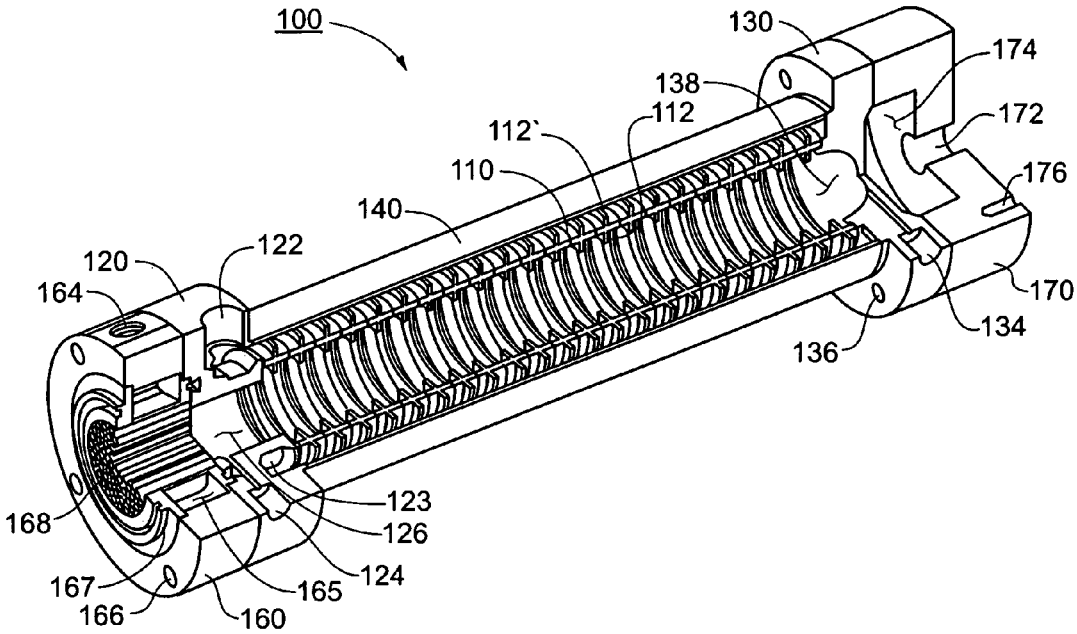
FIG. 3 is a perspective view illustrating a gas target according to an embodiment of the present invention.
Figure 4:
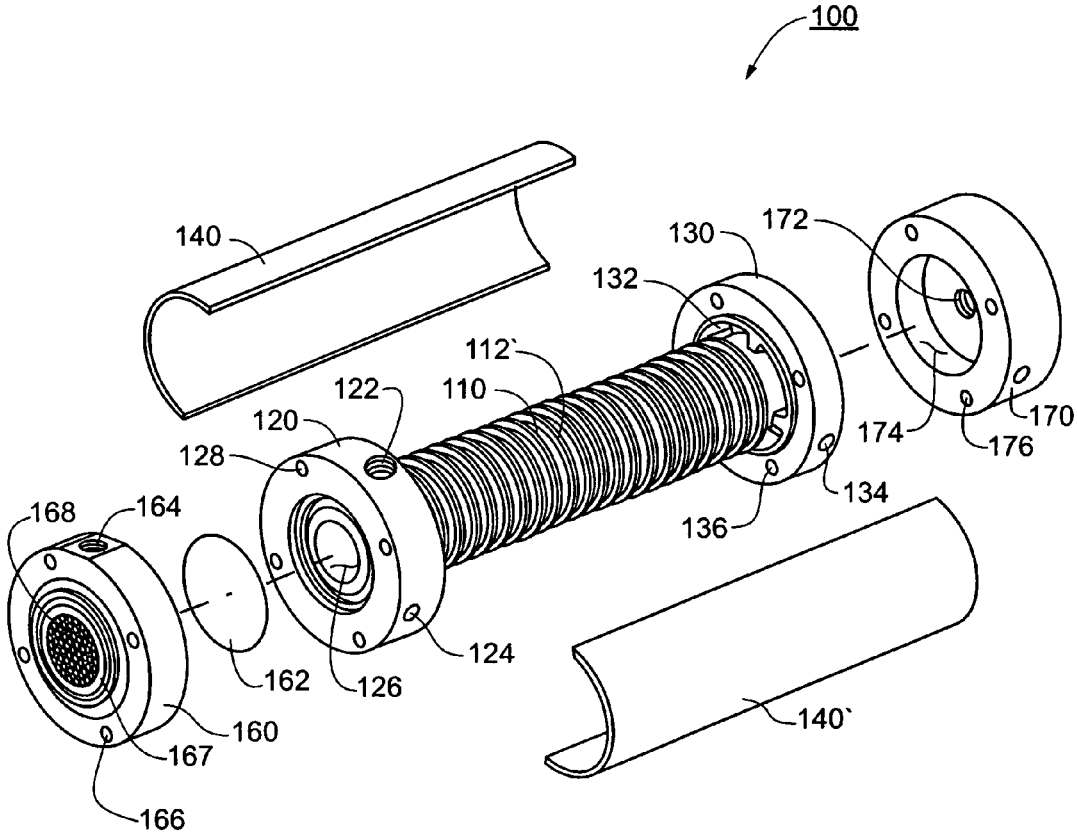
FIG. 4 is an exploded perspective view illustrating the gas target of FIG. 3.
Figure 5:
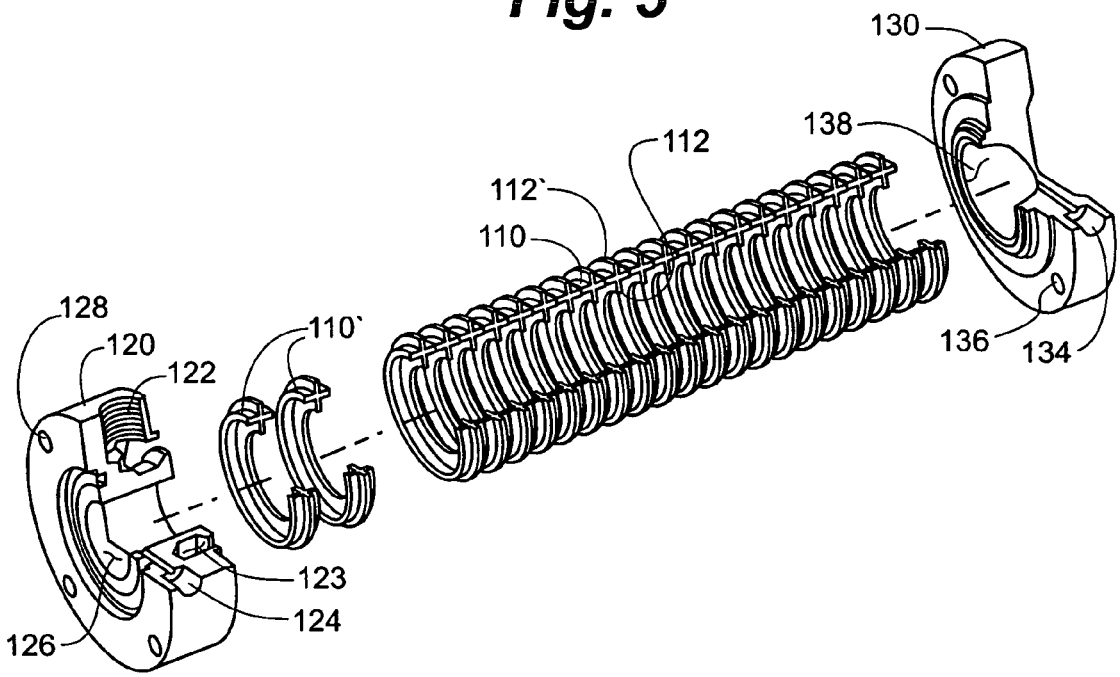
FIG. 5 is an exploded perspective view illustrating an example in which the target chamber of the gas target of FIG. 3 is configured of target chamber units.

The configuration of the body, which has been described above in brief, will be described below in greater detail with reference to FIGS. 3 through 5.

The body generally includes a front adaptor 120 coupled to a front end of the target chamber 110, a front flange 160 coupled to a front surface of the front adaptor 120, a rear adaptor 130 coupled to the rear end of the target chamber 110, a rear flange 170 coupled to a rear surface of the rear adaptor 130, and casings 140 and 140' coupled between the front adaptor 120 and the rear adaptor 130. For the sake of ease of manufacturing, the casings 140 and 140' are preferably made by cutting a cylindrical pipe into two pieces in a lengthwise direction.

The front adaptor 120 is shaped of a ring, a central part 126 of which is bored, and which has a circular groove 123 on a radial outer side of the central part 126, particularly between outer and inner circumferences thereof. The bored central part 126 communicates with the target gas inlet 124 through a front surface of the front adaptor 120, while the groove 123 communicates with the first coolant inlet 122 through a rear surface of the front adaptor 120. Here, since the central part 126 and the groove 123 of the front adaptor 120 are separated from each other, the target gas inlet 124 and the first coolant inlet 122 are also separated from each other.

This front adaptor 120 is coupled to the front end of the target chamber 110 such that the groove 123 is opposite to the target chamber 110. Thus, the bored central part 126 of the front adaptor 120 communicates with the hollow region of the target chamber 110, and the groove 123 of the front adaptor 120 is exposed to the rear side of a portion where the front adaptor 120 is coupled with the target chamber 110.

The rear adaptor 130 coupled to the rear end of the target chamber 110 includes the target gas outlet 134 in an outer circumference thereof which communicates with the hollow region of the target chamber 110, and at least one slot 132 in an inner circumference thereof at a portion where the rear adaptor 130 is coupled with the target chamber 110. Thus, similar to the groove 123 of the front adaptor 120, the slot 132 is also exposed to the front side of the portion where the rear adaptor 130 is coupled with the target chamber 110.

Further, the rear adaptor 130 includes a concave space 138, into which the gas in the target chamber 110 can be collected, and which is recessed from the portion where the rear adaptor 130 is coupled to the rear end of the target chamber 110. In this case, the target gas outlet 134 preferably communicates with the concave space 138.

The casings 140 and 140' in the shapes of a pipe are coupled between the front adaptor 120 and the rear adaptor 130 in such a manner that they enclose the outside of the groove 123 of the front adaptor 120 and the outside of the slot 132 of the rear adaptor 130. Thus, the outside of the target chamber 110 is airtightly sealed by the casings 140 and 140', and the coolant channel through which the groove 123 of the front adaptor 120 and the slot 132 of the rear adaptor 130 are coupled is defined by the casings 140 and 140'.

The front surface of the front adaptor 120 is coupled with the front flange 160 having the grid structure 168 that is the entrance to which the proton beam is applied. The thin metal sheet 162 is disposed between the front adaptor 120 and the front flange 160. The grid structure 168 is formed in a substantially cylindrical shape, and serves to support the thin metal sheet 162 disposed between the front adaptor 120 and the front flange 160.

The front adaptor 120 is provided with a plurality of through holes 128, which pass between the outer circumferences of the front and rear surfaces of the front adaptor 120, and the front flange 160 is provided with a plurality of through holes 166, which pass between the outer circumferences of the front and rear surfaces of the front flange 160. Thus, the front adaptor 120 and the front flange 160 are coupled with each other through the through-holes 128 and 168. For example, the through-holes 128 and 166 are provided with screw threads on inner circumferences thereof, and then are fastened with bolts corresponding to the screw threads.

Further, the front flange 160 includes a channel for cooling the surroundings of the grid structure 168, and a second coolant inlet 164 and a second coolant outlet (not shown) which communicate with the channel and are formed so as to be opposite to each other. A method of forming the channel connected to the second coolant inlet 164 and the second coolant outlet in the front flange 160 will be described by way of example. A groove 165 is formed around the grid structure 168 of the front flange 160, and then is covered with an annular cover member 167 in the front thereof. A coolant, which is identical or similar to the coolant flowing along the outer surface of the target chamber 110, flows through the second coolant inlet 164 and the second coolant outlet.

The rear surface of the rear adaptor 130 is coupled with the rear flange 170 having the first coolant outlet 172. The first coolant outlet 172 of the rear flange 170 communicates with the slot 132 of the rear adaptor 130. Preferably, in the case in which there are two or more slots 132, the first coolant outlet 172 must be formed in the center of the group of slots 132. Thus, according to the embodiment of the present invention, the first coolant outlet 172 is formed in the center of the rear surface of the rear flange 170.

Further, the first coolant outlet 172 preferably communicates with the slot 132 through a storage space 174, which is recessed from the front surface toward the rear surface of the rear flange 170. This is because the storage space 174 functions to absorb shock so as to help the coolant smoothly flow from the slot 132 to the first coolant outlet 172.

Here, the rear adaptor 130 is provided with a plurality of through-holes 136, which pass between the outer circumferences of the front and rear surfaces of the rear adaptor 130, and the rear flange 170 is provided with a plurality of through-holes 176, which pass between the outer circumferences of the front and rear surfaces of the rear flange 170. Thus, the rear adaptor 130 and the rear flange 170 are coupled with each other through the through-holes 136 and 176, which is equal to the coupling method of the rear adaptor 130 and the rear flange 170. In detail, the through-holes 136 and 176 are provided with screw threads on inner circumferences thereof, and then are fastened with bolts corresponding to the screw threads.

Figure 6A:
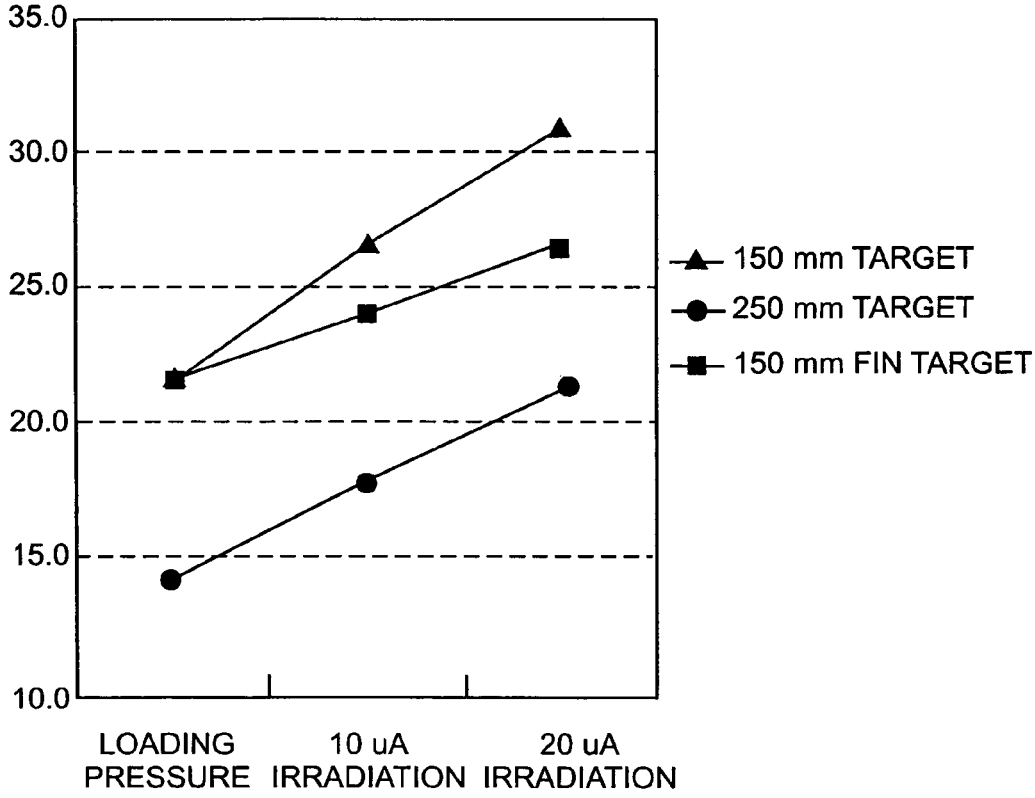
FIG. 6A is a graph showing a change in pressure in a target chamber when beams of protons having capacities of current of 10 μA and 20 μA are irradiated in an initial state in which target gas is filled in the target chamber.
Figure 6B:
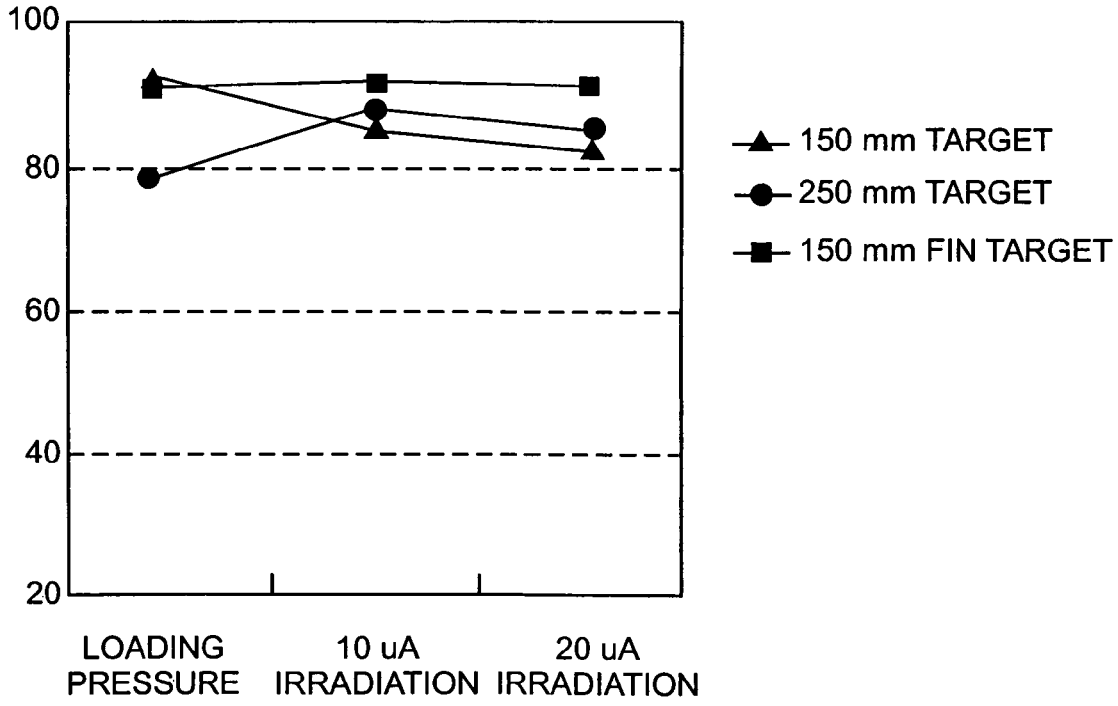
FIG. 6B is a graph showing a production yield of isotopes in the cases of FIG. 6A.

In the embodiments of the prevent invention, the radioisotope production gas target shows the following effects as can be clearly seen from FIGS. 6A and 6B.

FIG. 6A is a graph showing a change in pressure in a target chamber when beams of protons having capacities of current of 10 82 A and 20 μA are irradiated in an initial state in which target gas is filled in the target chamber, and FIG. 6B is a graph showing a yield of production of isotopes in the cases of FIG. 6A.

Comparing pressure data of the gas target of the embodiment of the present invention with that of a conventional gas target in the case in which the target chamber has a length of 150 mm, it can be found that the increase in pressure is remarkably reduced in the case of the embodiment of the present invention. Of course, in the case in which the target chamber has a length of 250 mm, the gas target of the embodiment of the present invention in which the target chamber has a length of 150 mm shows that the pressure thereof is higher than that of the conventional gas target. However, this is responsible for an initial pressure difference in the target chamber. As such, from the viewpoint of the production yield of the isotopes, it can be seen that the gas target of the embodiment of the present invention is very stable regardless of the length of the target chamber regardless of the production yield as well as the capacity of current of the proton beam, as compared to the conventional gas target.

The improvement of the stable production yield of the gas target in the embodiment of the present invention can be regarded to result from inhibiting the pressure in the target chamber from being increased.

Thus, the gas target of the embodiment of the present invention shows a lower increase in pressure in the case of the same capacity of current, as compared to the conventional gas target. As such, the proton beam having a higher capacity of current can be irradiated, so that the production yield can be increased, and be maintained with higher reliability. Thereby, the gas target of the embodiment of the present invention can obtain the gas isotopes desired by a user at a larger quantity over a shorter time.

Further, when the pressure increase in the target chamber is inhibited, the thin metal sheet vulnerable to high pressure can be used for a longer time in addition to the improvement of the production yield, so that the durability of the entire gas target having the thin metal sheet can be improved.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A radioisotope production gas target comprising a target chamber, a front adaptor, a rear adaptor, casings, a front flange, a rear flange and a metal sheet, wherein the target chamber is shaped of a hollow cylinder having an interior volume and has a plurality of inner fins protruding from an inner surface along a length of the target chamber;

the front adaptor being shaped of a ring, a central part of which is bored, and which has a first circular groove on a radial outer side of the central part;

the front adaptor having a target gas inlet communicating with the bored central part through a front surface of the front adaptor and feeding target gas to the interior volume of the target chamber, and a first coolant inlet communicating with the first circular groove through a rear surface of the front adaptor and feeding a coolant flowing along an outer surface of the target chamber, and the front adaptor being coupled to a front end of the target chamber such that the bored central part communicates with the interior volume of the target chamber with the first circular groove facing the target chamber;

the rear adaptor that is coupled to a rear end of the target chamber, which includes a target gas outlet in an outer circumference thereof communicating with the interior volume of the target chamber and collecting the target gas after a nuclear reaction occurs, and which includes at least one slot in an inner circumference thereof at a portion where the rear adaptor is coupled with the target chamber;

the casings being coupled between the front adaptor and the rear adaptor so as to enclose an outside of the groove of the front adaptor and an outside of the slot of the rear adaptor, the casings enclosing the target chamber and defining an annular space therebetween through which the coolant flowing along the outer surface of the target chamber flows;

the front flange having a grid structure supporting the metal sheet and the front flange being coupled to the front surface of the front adaptor; and the rear flange having a first coolant outlet discharging the coolant flowing along an outer surface of the target chamber and coupled to a rear surface of the rear adaptor, and wherein the metal sheet is disposed between the front adaptor and the front flange, and wherein the front flange includes a second groove formed around the grid structure, and a cover member covering a front of the second groove, and has a second coolant inlet in an outer circumference thereof.

2. The radioisotope production gas target as set forth in claim 1, wherein the target chamber comprises a plurality of conjoined target chamber units, each target chamber unit having at least one of the inner fins.

3. The radioisotope production gas target as set forth in claim 2, wherein the target chamber includes a welded joint between the target chamber units.

4. The radioisotope production gas target as set forth in claim 1, wherein the target chamber includes a plurality of outer fins protruding from the outer surface thereof along the length thereof.

5. The radioisotope production gas target as set forth in claim 1, wherein the target chamber includes a plurality of outer fins protruding from the outer surface thereof along the length thereof and comprises a plurality of conjoined target chamber units, each target chamber unit having at least one of the inner fins and at least one of the outer fins.

6. The radioisotope production gas target as set forth in claim 1, wherein the target chamber includes a plurality of outer fins protruding from the outer surface thereof along the length thereof and comprises a plurality of conjoined target chamber units, each target chamber unit having at least one of the inner fins and at least one of the outer fins, and the target chamber includes a welded joint between the target chamber units.

7. The radioisotope production gas target as set forth in claim 1, wherein the rear adaptor includes a concave space recessed from a portion where the rear adaptor is coupled to the rear end of the target chamber.

* * * * *